United States Patent [19]

Nakagawa et al.

[11] 4,084,622

[45] Apr. 18, 1978

[54] TEXTURED POLYESTER YARNS AND PROCESS FOR THE PRODUCTION THEREOF

[75] Inventors: Kiyoshi Nakagawa; Yukio Otaki; Masatoshi Mineo, all of Mishima; Yoshio Aratani, Otsu; Yoshio Tatsuoka, Otsu; Haruhiko Kusakabe, Otsu, all of Japan

[73] Assignee: Toray Industries Inc., Tokyo, Japan

[21] Appl. No.: 781,709

[22] Filed: Mar. 28, 1977

Related U.S. Application Data

[63] Continuation of Ser. No. 692,137, Jun. 2, 1976, abandoned.

[30] Foreign Application Priority Data

| | | |
|---|---|---|
| Jun. 11, 1975 | Japan | 50-69585 |
| Jun. 11, 1975 | Japan | 50-69586 |
| Jun. 11, 1975 | Japan | 50-69587 |
| Jun. 11, 1975 | Japan | 50-69588 |

[51] Int. Cl.[2] ..... D03D 15/10; D01D 5/20; D02G 3/34

[52] U.S. Cl. ..... 139/420 R; 57/140 J; 57/157 TS

[58] Field of Search ..... 57/36, 37, 38.3, 38.4, 57/51.2–51.6, 140 R, 140 J, 144, 157 R, 157 S, 157 TS; 139/420 R; 264/290 R, 290 T; 428/397

[56] References Cited

U.S. PATENT DOCUMENTS

| | | | |
|---|---|---|---|
| 2,955,324 | 10/1960 | Morgan | 57/140 J |
| 3,117,173 | 1/1964 | Adams | 264/290 TX |
| 3,127,915 | 4/1974 | Bottomley | 57/140 J |
| 3,415,918 | 12/1968 | Holton et al. | 264/290 T X |
| 3,964,249 | 6/1976 | Werner et al. | 57/140 J |
| 3,977,173 | 8/1976 | Kosaka et al. | 57/140 J |

OTHER PUBLICATIONS

Japanese Patent Publication — 48-70954/1973, 6/23/73, publication date 2/27/75.

*Primary Examiner*—Donald Watkins
*Attorney, Agent, or Firm*—Miller & Prestia

[57] ABSTRACT

A textured polyester yarn having improved variation in dyeability along its length is composed of a plurality of individual filaments each having thick and thin sections randomly distributed along the filament axis, said yarn having an Uster evenness value of 1.0 to 10.0%, a T index of 3 to 30 and a variation in reflected light intensity in a continuous dyeing test of ±0.15 to ±0.80 and said yarn preferably having not-untwisted portions containing genuine twists of a fixed direction intermittently retained at random along its length. The yarn is produced by false twisting a polyester yarn composed of a plurality of individual filaments each having variation in cross-sectional area along its length, in which the thick sections have a birefringence of 15 to $80 \times 10^{-3}$ and the thin sections have a birefringence of 90 to $200 + 10^{-3}$, at a temperature of not lower than 180° C and under a twisting tension of 0.05 to 0.8 g/d with a variation with respect to the average twisting tension of ±5 to ±20%.

14 Claims, 6 Drawing Figures

TEXTURED POLYESTER YARNS AND PROCESS FOR THE PRODUCTION THEREOF

This is a continuation of application Ser. No. 692,137, filed June 2, 1976, now abandoned.

The invention relates to a textured polyester yarn latently having variation in dyeability along its length so that a knitted or woven fabric from the yarn can have a favorable color tone of a unique sprinkly colored effect when dyed. The invention also relates to a process for the production of such as yarn.

DESCRIPTION OF THE PRIOR ART

Polyester multifilament yarns are known, in which the individual filaments contain thick sections having comparatively lower molecular orientation and thin portions having comparatively higher molecular orientation. However, the known yarns are not practically useful due to the fact that it is difficult to subject them to false-twisting or dyeing. This is because these yarns are usually produced be stretching an undrawn yarn of polyester filaments having a birefringence of 0.5 to $10\times10^{-3}$ and, thus, they become fragile in the sections having lower molecular orientation when the sections have been crystallized.

We have already proposed, in Japanese patent application No. 48-70954 (automatically laid-open specification No. 50-18717) and in Japanese patent application No. 48-70955 (automatically laid open specification No. 50-18718), a process for the production of a yarn composed of polyester multifilaments having thick and thin sections from a highly oriented polyester undrawn yarn. We have further proposed, in Japanese patent application No. 48-70953 (automatically laid open specification No. 50-18716) Japanese patent application and in No. 48-135236 (automatically laid-open specification No. 50-88356, a process for the production of a textured polyester yarn having variations in dyeability along its length by false twisting a yarn such as obtained by the process proposed in Japanese patent application No. 48-70954.

However, the process of Japanese patent application No. 48-135263 is characterized by false twisting a material yarn under conditions such that the thick sections of the material yarn are not stretched and, thus, produces a yarn generally having an Uster evenness value of more than 1.0%. Thus, the yarn obtained by this process has such defects that a knitted or woven fabric from the yarn tends to have too large a difference in color shades when being dyed and to have a hard, rough feel due to the retention of many thick sections where the filaments have been crimped without being stretched.

Also, the production of a false twisted yarn from an undrawn yarn of polyester multifilaments having thick and thin sections is disclosed, for example, in Japanese patent publication No. 51-11218 and Japanese patent application No. 47-105092 (automatically laid-open specification No. 49-62718). However, these yarns also have the defects as mentioned above.

Further, it is well known that not-untwisted portions are produced in the conventionally false twisted yarns. Since the not-untwisted portions are usually recognized as a defect in the fabric knitted or woven from the yarn having such portions, much effort has been exerted in conventional false-twisting to avoid the production of such not untwisted portions in the false twisted yarns.

OBJECT OF THE INVENTION

The present invention makes it possible to remove the defects of the textured polyester yarns as mentioned above. The present invention also makes it possible to advantageously utilize the production of the not-untwisted portions which has been recognized as a defect in conventional false-twisting.

Thus, it is an object of the invention to provide a textured polyester multifilament yarn in which the difference in thickness along the yarn length is comparatively reduced by randomly distributing the thick sections of the individual filaments in the yarn, in which yarn not-untwisted portions having genuine twists of a fixed direction are randomly retained along the yarn length and which yarn can give a favorable color tone of a sprinkly colored effect to a knitted or woven fabric from the yarn when dyed.

Another object of the invention is to provide a textured polyester multifilament yarn in which the thickness is not even but the difference in thickness along the yarn length is not too large and which can produce a desirable feel in hand on a fabric which is knitted or woven from the yarn.

A further object of the invention is to provide a process for the production of the textured polyester multifilament yarn as mentioned above.

DETAILED DESCRIPTION OF THE INVENTION

The invention provides a textured polyester yarn having improved variation in dyeability along its length, which is composed of a plurality of individual filaments each having thick and thin sections randomly distributed along the filament axis and which has an Uster evenness value of 1.0 to 10.0%, a T index of 3 to 30, a variation in reflected light intensity in a continuous dyeing test of $\pm0.15$ to $\pm0.80$ and a broken filament count of not more than 100 per 2,000 m. The yarn of the invention preferably has not-untwisted portions containing genuine twists of a fixed direction intermittently retained at random along its length.

In the yarn of the invention, it is important that it has an Uster evenness value of 1.0 to 10.0%, preferably, 1.5 to 8.0% and a T index of 3 to 30, preferably, 5 to 25. Where the Uster evenness value is less than 1.0% and the T index is less than 3, the amount of the deep colored portions of the yarn when being dyed is disadvantageously limited, and where the Uster evenness value is more than 10% and the T index is more than 30, the amount of the deep colored portions of the yarn when being dyed becomes too large. Thus, in both cases, the yarn has an inferior balance of the deep colored portions to the light colored portions when being dyed and, therefore, can not produce a knitted or woven fabric capable of having a desirable color tone of a sprinkly colored effect.

The Uster evenness value and the T index both are characteristic values indicating the variation in the thickness of a multifilament yarn and may be determined as follows.

Determination of Uster Evenness Value

Figure 1:
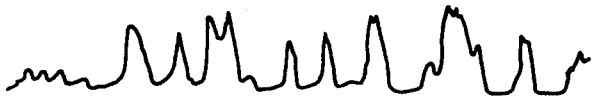
FIG. 1 is a Uster evenness chart showing the variation in thickness of a textured polyester multifilament yarn according to the invention along the yarn length.

The Uster evenness value may be determined according to the ASTM methods D 1425-67. That is, using a commercially available Uster Evenness Tester, an Uster evenness curve with respect to a yarn being false twisted on a false-twisting apparatus at a yarn speed of 4 m/min and at a spindle rotation of about 1,500 r.p.m. is drawn on a chart at a chart speed of 25 cm/min as shown in FIG. 1. Then, from the chart obtained for 3 minutes, the Uster evenness value is read by means of an integrator. The Uster evenness value is recorded as the average of at least fifteen measurements, at at least five points in three zones, the zones dividing the length of the yarn composing one package approximately equally.

Determination of T Index

Figure 2:
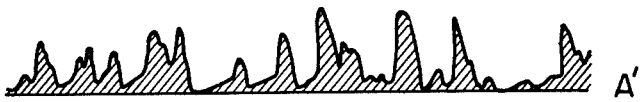
FIG. 2 is a chart of a textured polyester multifilament yarn according to the invention along the yarn length prepared for determining its T index.

An Uster evenness curve is drawn as mentioned above on a standard chart marked off from 0 to 100% so that the portion of the curve corresponding to the thinnest sections of the yarn coincides with the 0% base line A' as shown in FIG. 2. Then, the area between the curve and the 0% base line A' with respect to a portion corresponding to a yarn length of 8 m is determined. The T index of 1 corresponds to the area of 0.333 $cm^2$.

In the yarn of the invention, it is also important that it has a variation ($\Delta L/\bar{L}$) in reflected light intensity, in a continuous dyeing test as mentioned hereinafter, of $\pm 0.15$ to $\pm 0.80$, preferably $\pm 0.20$ to $\pm 0.60$. Where the variation in reflected light intensity is less than $\pm 0.15$, the yarn has too small a difference in color shades when dyed and where the variation in reflected light intensity is more than $\pm 0.80$, the yarn has too large a difference in color shades. Thus, in either case, the yarn can not produce a knitted or woven fabric capable of having a desirable color tone of a sprinkly colored effect.

Continuous Dyeing Test

The method as disclosed in U.S. Pat. No. 3,945,181 may be employed. Light is irradiated to a multifilament yarn being continuously dyed while running, the reflected light is measured by a photocell to detect the variation in shade of color as the reflected light intensity and the variation is recorded on a paper as an L value (brightness value) curve. From the L value curve, an average value $\bar{L}$ and its amplitude $\Delta L$ are determined as the average of a portion corresponding to a yarn length of 4 m. The measurement is repeated with respect to two or three different portions of the yarn.

However, it should be noted that since the portional difference in the configuration of the yarn is large, the variation in color shades can not be detected merely by measuring the reflected light intensity. Thus, the variation in color shades of the yarn can be detected, without being affected by the difference in the configuration of the yarn, by dividing the reflected light into two by means of a half mirror and detecting, by means of two photocells, one of the two divided lights as the visible light intensity through a visible range filter and the other as the infrared light intensity through an infrared range filter. Then, the ratio of the two intensities is put out as the logarithm thereof.

The yarn to be tested is run at a speed of 3 m/min while being subjected to a tension of about 0.6 g/d, treated in water at 70° C for 3 minutes and continuously introduced into a dye bath maintained at 90° C. The dye bath contains 20 g/l of Diacelliton Fast Blue B (C.I. Disperse Blue 3) and 3 g/l of a nonionic dispersing agent. The yarn is dyed for 3 minutes, washed with water at 70° C for 3 minutes and then dried. The yarn is then subjected to the measurement as mentioned above.

In the yarn of the invention, the broken filament count is preferably not more than 100, more preferably not more than 80, per a 2,000 m length. Where the broken filament count is more than 100 per 2,000 m, the yarn has inferior processability and, thus, it becomes difficult to knit the yarn into a fabric. Where the yarn is to be woven, it is preferred that the broken filament count of the yarn is not more than 80 per 2,000 m because troubles such as yarn breakage and the like are reduced upon warping and also the yarn has superior processability in sizing or twisting. The broken filament count may be measured by means of a device such as disclosed in Japanese patent publication No. 49-20813.

In general, a conventional false twisted yarn has a broken filament count of 0 to 10 per a 2,000 m length and a conventional spun yarn has a broken filament count of 13,000 to 100,000 per a 2,000 m length, if they are counted by the device as used for the measurement of the broken filament count of a yarn of the invention.

The individual filaments composing the textured polyester yarn of the invention have a distribution of increased and decreased cross-sectional areas along their length. The ratio in cross-sectional area of the thickest sections to the thinnest sections is preferably 1.4 to 2.7. It is also preferable that the yarn has more sections having a medium thickness between those of the thickest and the thinnest sections, than those of the material yarn from which the textured yarn has been produced.

Further, it is particularly preferable that in the textured polyester yarn of the invention, not less than 20 per 100 m of yarn length of not untwisted portions containing genuine twists of a fixed direction are retained intermittently and randomly along the yarn length.

Figure 3:
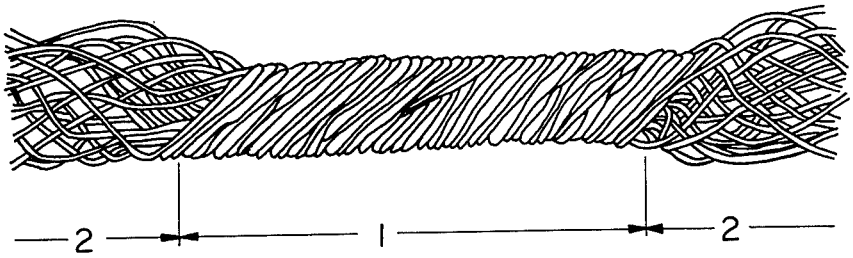
FIG. 3 is an enlarged view of the not-untwisted and untwisted portions of a textured polyester multifilament yarn according to the invention.

As shown in FIG. 3, the not untwisted portion 1 of the yarn possesses a sufficient number of twists wherein the number of twists is one half or more of the number of twists imparted in the false-twisting, while the untwisted portion 2 has a configuration similar than that of a conventional false twisted yarn. In the untwisted portion, each of the filaments which compose the yarn has crimps to give bulkiness to the portion. Although the untwisted portion 2 should have twists of the opposite direction having a number of twists corresponding to that of the not-untwisted portion, said opposite twists can not be seen. In the not-untwisted portions of the yarn, the direction of the twists is fixed and is the same as the twisting direction in the false-twisting. The not-untwisted portions have a short length of 1 to 150 mm, preferably 1 to 50 mm, and 20 to 1,500 such portions exist per 100 m of yarn length.

The yarn of the invention has a large twist retention coefficient, such as not less than 70, as measured by the measuring method as mentioned below, and the twists of the yarn are maintained under a tension of 0.1 to 0.5 g/d. Thus, the yarn can maintain the not-untwisted portions of the genuine twists, even after it has been subjected to tensioning forces during knitting or weaving and dyeing.

Measurement of Twist Retention Coefficient

Figure 6:
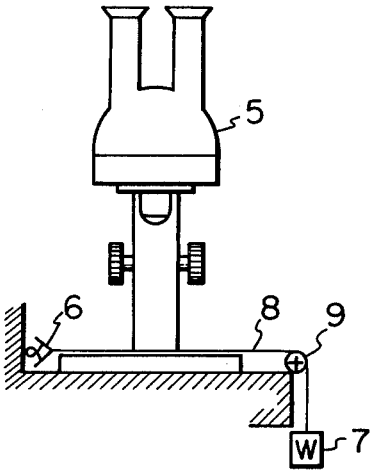
FIG. 6 is a front view of a device usable for the determination of the twist retention coefficient of the not untwisted portions of a yarn.

The twist retention coefficient of the not-untwisted portion may be measured using the measuring device as shown in FIG. 6.

A not-untwisted portion of a yarn 8 to be tested is placed within the visible range of a binocular microscope 5 and one end of the yarn is fixed by a clamp 6. The yarn is held horizontally through a pulley 9 and an initial load 7 of 0.1 g/d is added to the other end of the yarn hanging downward from the pulley. Then, the number of twists $T_1$ per 1 cm is read by means of the microscope 5. Thereafter, the initial load is removed and a measuring load of 0.5 g/d is added and maintained for 30 seconds. Then, the initial load is again added in place of the measuring load and maintained for 30 seconds and, then, the number of twists $T_2$ per 1 cm is read by means of the microscope 5. The twist retention coefficient P may thus be calculated by the equation:

$$P = (T_2/T_1) \times 100$$

Thus, it should be appreciated that the twist retention coefficient indicates the extent of retention of twists in a yarn having genuine twists after the yarn has been elongated under a certain load and the length of the yarn has been restored. That is, the twist retention coefficient indicates the degree of resistance to the disappearance of the twists of the yarn having genuine twists under a tensioning force.

In order to maintain the coherent configuration of the yarn in a final textile article, such as a knitted or woven and dyed fabric, and to produce a fancy effect on the final textile article, the configuration giving the coherency to the yarn must not be decomposed under tensions to which the yarn is subjected during the processing stages for producing the final article from the yarn. It has been recognized that the largest tension to which the yarn is subjected during the production of a fabric is a tension of 0.3 to 0.4 g/d such as instantaneously and repeatedly imparted during weaving.

The yarn of the invention has a twist retention coefficient of not less than 70, generally 80 to 90, in the not-untwisted portions. Thus, the yarn of the invention has very high retentivity of twists and, therefore, can produce a desirable fancy effect in the final articles produced from the yarn.

Polyester, which composes the textured yarn of the invention, may be a homopolymer of ethylene terephthalate or a copolymer of ethylene terephthalate with a copolymerizable monomer containing not less than 80.0 mol % of ethylene terephthalate units. As the copolymerizable monomer, one or more monomers selected from dibasic acids, such as adipic acid, sebacic acid, isophthalic acid and diphenyldicarboxylic acid, hydroxy acid such as hydroxybenzoic acid, and glycols such as diethylene glycol, propylene glycol, neopentyl glycol, pentaerythritol and polyethylene glycol monomethyl ether, may be used.

The textured polyester multifilament yarn of the invention as mentioned hereinbefore can be produced by false twisting a polyester yarn composed of a plurality of individual filaments each having variation in cross-sectional area along its length.

In the material yarn to be employed in the false-twisting, the individual filaments should have a birefringence of 15 to $80\times10^{-3}$, preferably 25 to $80\times10^{-3}$, in the thick sections and a birefringence of 90 to $200\times10^{-3}$ in the thin sections in view of the variation in dyeability of the yarn to be obtained and of the processability in the false-twisting.

Where the thick sections have a birefringence of less than $15\times10^{-3}$, yarn breakage frequently occurs and many broken filaments are produced in the false-twisting process. If a yarn having thick sections of a birefringence of not less than $15\times10^{-3}$ is employed, the broken filament count produced in the false-twisting is advantageously reduced and, thus, it is preferable to employ a yarn having thick sections of a birefringence of not less than $25\times10^{-3}$ in the case where a yarn of particularly limited broken filament count is to be produced. In turn, where the thick sections have a birefringence of more than $80\times10^{-3}$, the variation in dyeability of the obtained yarn is disadvantageously limited to such an extent that a desirable difference in color shades can not be obtained when the yarn is dyed.

Further, if a material yarn of individual filaments is employed wherein the ratic in cross-sectional area of the thick sections to the thin sections is less than 1.4, the variation in thickness of the obtained yarn is not sufficient and too small a difference in color shades is obtained when the obtained yarn is dyed. Also, if a material yarn of individual filaments is employed wherein the ratio in cross-sectional area of the thick sections to the thin sections is more than 2.7, it is difficult to obtain a desired textured yarn. Thus, in the false-twisting according to the invention, it is preferable to employ, as a material, a yarn of individual filaments wherein the ratio is cross-sectional area of the thick sections to the thin sections is from 1.4 to 2.7, more preferably from 1.4 to 2.25. In the case where the filaments have a circular cross-section, this ratio of 1.4 to 2.7 corresponds to a ratio in diameter of the thick sections to the thin sections of 1.2 to 1.65. Furthermore, the lengths of the thick sections of the filaments of the material yarn are preferably not more than 100 mm, more preferably not more than 70 mm, since a desirable textured yarn can not be obtained if the lengths and spacings of the thick sections of the individual filaments are too large in the material yarn.

The extent of the variation in thickness of a multifilament yarn can not be indicated by only the ratio in cross-sectional area of the component filaments or the birefringence and, thus the extent of the variation in thickness of such a yarn should also be noted from the point of view of the evenness is thickness which may be known from an evenness curve such as the Uster evenness curve as hereinbefore mentioned. Thus, in order to obtain a textured yarn capable of producing a desirable color tone of a sprinkly colored effect on a fabric produced from the yarn, the material yarn to be fed to the false-twisting should preferably have an Uster evenness value of 1.0 to 15%, more preferably 6 to 13%, and a T index of 20 to 90, more preferably 25 to 80.

The above-mentioned material polyester yarn may be obtained as described in Japanese patent application No. 48-70955 hereinbefore mentioned by non-uniformly drawing a highly oriented polyester undrawn yarn having a birefringence of 15 to $60\times10^{-3}$ on a conventional draw-twister at a draw ratio of 1.1 to 2.7, by means of a hot pin of a temperature ranging from (Tg-50)° C to (Tg+50)° C, wherein Tg is the glass-transition temperature of the yarn.

The false-twisting according to the invention may be carried out at a temperature of 180° to 230° C and under a twisting tension of 0.05 to 0.8 g/d, with a variation with respect to the average twisting tension of ±5 to ±20% and an untwisting tension of 0.1 to 0.8 g/d. Preferably, the false-twisting is carried out on a single heater type or double heater type false-twisting apparatus under the following conditions: a feed percentage (percentage of the feed speed of the yarn to the delivery speed thereof) of −6 to −20%; a twisting tension of 0.05 to 0.8 g/d, preferably 0.08 to 0.5 g/d; an untwisting tension of 0.1 to 0.8 g/d, preferably 0.15 to 0.6 g/d; a variation in twisting tension with respect to the average twisting tension of ±5 to ±20%; a heater temperature of 180 to 230° C, and; a number of twists in T/M of 23,000 $\sqrt{\delta/D}$ to 27,000 $\sqrt{\delta/D}$, wherein D is the total denier of the yarn and δ is the specific gravity of the yarn. In the false-twisting operation, the distribution and the length of the thick and thin sections of the component filaments of the obtained yarn, and the distribution and length of the not untwisted portions of the obtained yarn can be controlled by suitably combining the properties of the employed material yarn with the false-twisting conditions within the above-mentioned ranges. The twisting tension refers to a tension before spindle and the untwisting tension refers to a tension after spindle.

Among the above-mentioned false-twisting conditions, the temperature, the tension and the number of twists are very important and, particularly, of these, the tension is the most important. If the twisting tension is less than 0.05 g/d, it is difficult to carry out the false-twisting stably. Further, since the false-twisting can be carried out more stably under a tension slightly higher than the lower limit of the twisting tension, it is preferable to carry out the false-twisting under a twisting tension of not less than 0.08 g/d. If the twisting tension is more than 0.80 g/d, the variation in thickness of the component filaments of the obtained yarn becomes too small and, thus, too small a difference in color shades is obtained when the yarn is dyed. In order to obtain a textured yarn capable of producing a desirable color tone of a sprinkly colored effect on a fabric produced from the yarn, it is preferable to carry out the false-twisting under a tension of not more than 0.5 g/d.

However, a fabric having a desirable color tone of a sprinkly colored effect and a favorable feel can not be obtained from the yarn produced merely by employing the twisting tension falling within the above-discussed range. Thus, it is very important to control the variation in twisting tension within the range of ±5 to ±20% with respect to the average twisting tension. The variation in twisting tension can be controlled by positively vibrating the yarn at the false-twisting zone, by regulating the properties of the material yarn by changing the yarn speed, ratio or temperature in the drawing or by precisely regulating the speeds of the feed and delivery rollers of the false-twisting apparatus employed. The variation in twisting tension may be measured as follows.

Measurement of Variation in Twisting Tension

The variation in the tension imparted to the yarn is recorded on a paper using an oscillograph recordable to a value of about 100 Hz by inserting a tensiometer detectable to a value of about 150 Hz into the twisting zone of the false-twisting apparatus employed. Then, the variation in twisting tension with respect to the average twisting tension $\pm A/\overline{T}\times100(\%)$ is calculated from the amplitude A and average tension $\overline{T}$ of the recorded variation.

In the textured yarn of the invention, the thick sections to be deeply dyed and thin sections to be lightly dyed of the component filaments are randomly distributed along the yarn length. Thus, the yarn produces a desirable and unique color tone of a sprinkly colored effect in a fabric produced from the yarn when the fabric is dyed. In addition, in the textured yarn of the invention, not untwisted portions having retained genuine twists randomly exist along the yarn length and these portions can also be deeply dyed to constitute a part of the deeply dyed portions of a fabric produced from the yarn. Thus, the existence of these portions can produce a further desirable color tone of a sprinkly colored effect.

Figure 4:
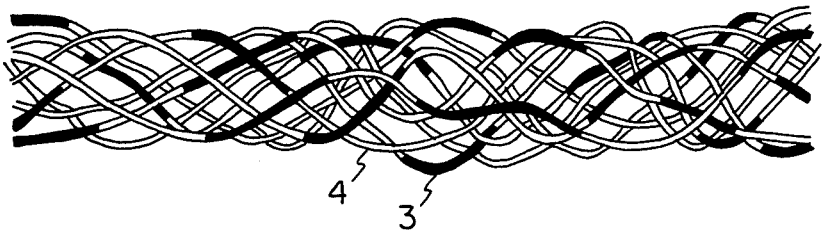
FIG. 4 is an enlarged schematical view of the untwisted portion of the yarn shown in FIG. 3, which has been dyed.
Figure 5:
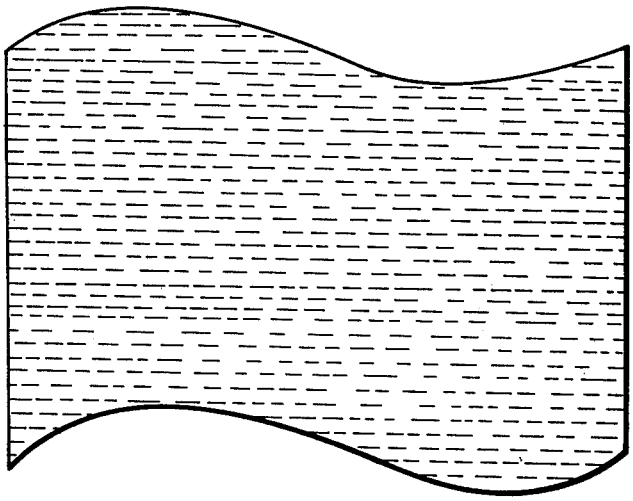
FIG. 5 is a schematical view of an example of the distribution of skip dents on the surface of a woven fabric in which a textured polyester multifilament yarn according to the invention is employed as a weft.

FIG. 4 shows a state of the component filaments in the untwisted portion of the yarn as shown in FIG. 3, which has been dyed at 80° C for one hour in a dye bath containing 3% o.w.f. of Dianix navy Blue ER-FS (C.I. Disperse Blue 142) and 10% o.w.f. of an ester of benzoic acid at a liquid ratio of 100:1. From the drawing, it should be noted that deeply dyed sections 3 and lightly dyed sections 4 exist randomly in the yarn.

The not-untwisted portions of the textured yarn of the invention are retained after the yarn is knitted or woven into a fabric and, thus, these portions on the fabric, being thinner than the remaining portions of the yarn, give a unique appearance to the fabric. For example, the not-untwisted portions produce random skip dents on the surface of the fabric. After the fabric is dyed and finished, the skip dents are not very conspicuous due to the crimping of the yarn. It is possible, if desirable, to make the skip dents completely inconspicuous by sufficiently crumpling the fabric during the dyeing or finishing.

Further, the not-untwisted portions are highly coherent and, therefore, the state of reflection of light from the portions in a fabric differs from that from the untwisted portions having a configuration similar to that of a conventional false twisted yarn. Thus, in this respect, a fabric of a unique appearance, wherein portions of different gloss are scattered, can be obtained from the yarn of the invention.

In the case where a fancy effect as mentioned above is to be produced on a fabric made from the yarn of the invention, it is desirable that the length of the not untwisted portions be small and that the number of these portions be large. For example, at least 500 of the not-untwisted portions are desirable in 1 $m^2$ of the fabric.

Desirable embodiments of the fabric obtainable from the textured polyester yarn of the invention are illustrated below.

The first embodiment of such a fabric is a knitted or woven fabric having a color tone or a sprinkly colored effect and comprising a textured polyester multifilament yarn having deeply dyed and lightly dyed portions at random along its length, and a broken filament count of not more than 100 per 2,000 m. In the fabric, the degree of deeply dyed portions as defined hereinafter is 30 to 50% and the lengths of the continuous deeply dyed portions are in a range of 0.25 to 8 cm.

The fabric may be obtained by weaving or knitting the textured polyester yarn of the invention, using it as a warp and/or weft, and dyeing the knitted or woven fabric. The degree of the deeply dyed portions of dyed fabric is suitably 30 to 50%, preferably 38 to 45%, and the lengths of the continuous deeply dyed portions are suitably in a range of 0.25 to 8 cm, preferably 1 to 5 cm. The average length of the continuous deeply dyed portions is suitably about 2.5 cm. Thus, the term "a fabric of a suitable or favorable color tone of a sprinkly dyed effect" as used herein may refer to, for example, a fabric having a degree of deeply dyed portions of 30 to 50% and lengths of the continuous deeply dyed portions falling within a range of 0.25 to 8 cm.

The above-mentioned degree of deeply dyed portions of a fabric may be defined as follows.

In the case of a woven fabric, the degree of deeply dyed portions is defined as the percentage of the number of floating yarn units of a relative L value ratio of not less than 1.35 to the total number of floating yarn units existing in an area of 10 cm × 10 cm of the fabric. The floating yarn unit refers to a unit of the warp or weft yarn in a section where the yarn composing the fabric comes out to the front surface and again goes into the fabric. The relative L value ratio refers to a ratio in L value of the lightly dyed portions to the deeply dyed portions.

In the case of a knitted fabric, the degree of deeply dyed portions is defined as the percentage of the number of loops of a relative L value ratio of not less than 1.35 to the total number of loops existing in an area of 10 cm × 10 cm of the fabric.

The number of floating yarn units or loops may be determined by actually counting the number using a magnifying glass. The length of the continuous deeply dyed portion may be determined by actually measuring the length of a section where the deeply dyed floating yarn units or the deeply dyed loops continuously exist.

The second desirable embodiment of the fabric obtainable from the textured polyester yarn of the invention is a woven fabric comprising a textured polyester multifilament yarn having a broken filament count of not more than 100 per 2,000 m. In this fabric both of the friction coefficients in the warp and weft directions are not more than 1.2, the ratio of the higher friction coefficient to the lower friction coefficient is not more than 1.5 in both directions and the specific volume is not less than 2.0 $cm^3/g$.

The woven fabric does not have a very large broken filament count and, thus, has a soft and smooth feel. It should be noted, however, that the textured polyester yarn of the invention may be used in a knitted or woven fabric as a blend with another type yarn. In such a case, the measurement of the deeply dyed portions as mentioned above may be carried out against only the yarn of the invention. The friction coefficient and the specific volume may be determined as follows.

Determination of Friction Coefficient

A sample of a fabric to be tested is fixedly placed on a plain plate horizontally placed. Another sample of the fabric is fixed to a rectangular plain plate of a size of 5 cm × 7 cm. The rectangular plate is then placed upon the plain plate so as to bring the two samples into contact with each other. A vertical load of 300 g is added to the rectangular plate and the rectangular plate is moved at a speed of 4.8 cm/min in the direction of the length thereof. Then, the maximum value of the moving resistance force is measured as a friction force using a stress measuring device. The friction coefficient is calculated as the ratio of the friction force to the vertical load. The friction coefficient of the warp direction is determined by placing the two samples so that the warp direction of one sample coincides with the warp direction of the after sample and moving the rectangular plate in the warp direction. The friction coefficient of the weft direction is similarly determined by moving the rectangular plate in the weft direction. The samples should be previously scored and conditioned in an atmosphere of 20° C ± 5° C and 65% ± 10% R.H. and the measurement should be carried out in said atmosphere.

Determination of Specific Volume

In an atmosphere as mentioned above, the thickness of a sample of a fabric to be tested is measured using a micrometer gauge. In the measuring, a load of 14 g per an area of 2 $cm^2$ is added to the sample. The specific volume is calculated as a volume per unit weight. The weight of the sample may be measured using a chemical balance. The volume may be calculated by the thickness and the area of the sample.

The invention will be further illustrated by the following Examples wherein the double refractions were measured by a polarizing microscope.

EXAMPLE 1

A thick and thin yarn was prepared by non-uniformly drawing at a draw ratio of 1.38 a polyethylene terephthalate undrawn yarn composed of 48 filaments having a birefingence of $41.6 \times 10^{-3}$. The individual filaments of the obtained thick and thin yarn had thick sections of a birefringence of $42 \times 10^{-3}$ and thin sections of a birefringence of $108 \times 10^{-3}$, the ratio in cross-sectional area of the thickest sections to the thinnest sections was 1.7, the average fineness of the obtained yarn was 155 denier and the Uster evenness value of the yarn was 11.0%.

The thick and thin yarn was then false twisted on a false-twisting machine at a speed of 400 m/min and at a temperature of 210° C. The false-twisting machine employed was of the type wherein a hot plate type heater having a length of 1.5 m and an external friction type twister capable of feeding the yarn were provided between a feed roller having a nip with an apron type roller and a delivery roller of the same construction as the feed roller. The twisting tension to which the yarn was subjected was 36 g, i.e. 0.23 g/d, and the variation in twisting tension was ±3.5 g, which corresponded to ±9.7% with respect to the average twisting tension. The number of twists imparted was 2,350 T/M and the broken filament count observed in the processed yarn was 6 per 2,000 m.

The ratio of the cross-sectional area of the thickest sections to that of the thinnest sections of the individual filaments composing the false twisted yarn was about 1.7, the Uster evenness value of the yarn was 2.5% and the T index of the yarn was 11. The variation in dyeability of the yarn, determined by the method as hereinbefore mentioned, was a $\Delta L/\bar{L}$ of ±0.33 and an $\bar{L}$ of 24% and, thus, the yarn was proved to have sufficient variation in dyeability.

A fabric woven from this yarn was dyed using a dye having tendency to result in uneven dyeing. The dyed fabric had a favorable color tone of a sprinkly colored effect.

EXAMPLE 2

A thick and thin yarn was prepared from a polyethylene terephthalate undrawn yarn composed of 30 filaments having a birefringence of $37 \times 10^{-3}$. The individual filaments of the obtained yarn had thick sections of a birefringence of $38 \times 10^{-3}$ and thin sections of a birefringence of $115 \times 10^{-3}$, and the ratio of the diameter of the thickest sections to that of the thinnest sections was 1.4.

The thick and thin yarn was then drawn at various draw ratios to obtain yarns having the various Uster evenness values and T index values indicated in Table 1 below. The yarns were then false twisted at a temperature of 210° C and the properties of the false twisted yarns were determined. The results are shown in the table. Run Nos. 1 and 6 are given for comparison purposes for clarifying the effects of the invention.

Table 1

| Run No. | | 1 | 2 | 3 | 4 | 5 | 6 |
|---|---|---|---|---|---|---|---|
| Properties of material yarn | Denier | 140 | 142 | 145 | 155 | 165 | 169 |
| | Uster evenness value (%) | 3.5 | 5.0 | 7.2 | 12.5 | 14.0 | 17.2 |
| | T index | 10 | 20 | 35 | 60 | 80 | 96 |
| Conditions of false-twisting | Twisting tension (g) | 15 | 13 | 33 | 33 | 31 | 15 |
| | Variation in tension (%) | ±4.5 | ±10 | ±9.3 | ±9.6 | ±9.0 | ±20 |
| | Twister *1 | S | S | F | F | F | S |
| Properties of false twisted yarn | Ratio of area *2 | 1.8 | 1.9 | 1.95 | 1.95 | 2.0 | 2.0 |
| | Uster evenness value (%) | 1.8 | 2.3 | 3.1 | 3.5 | 5.1 | 10.5 |
| | T index | 2.5 | 7 | 10 | 12 | 20 | 48 |
| | Broken filament count *3 | 0 | 0 | 2 | 5 | 18 | 83 |
| | $\Delta L/\bar{L}$ | ±0.14 | ±0.18 | ±0.31 | ±0.40 | ±0.60 | ±0.85 |
| State of woven and dyed Fabric | | Color variation is little observed | Color variation is good but not so remarkable | Color variation is very favorable | Color variation is very favorable | Color variation is highly remarkable | Color variation is too high |
| Remark | | — | — | — | — | — | Yarn breakage occurred |

*1 S represents spindle type and F represents friction type.
*2 Ratio of the crossectional area of the thickest sections to that of the thinnest sections
*3 Broken filament count per 2,000 m

EXAMPLE 3

A thick and thin yarn, wherein the thick sections of the individual filaments had a birefringence of $25 \times 10^{-3}$ and the thin sections had a birefringence of $135 \times 10^{-3}$ and the ratio of the diameter of the thickest sections to that of the thinnest sections was 1.45, was prepared by non-uniformly drawing at a draw ratio of 1.55 a polyethylene terephthalate undrawn yarn of 48 filaments having a birefringence of $25 \times 10^{-3}$. Then, the yarn was false twisted.

For comparison purposes, a polyethylene terephthalate undrawn yarn as mentioned above was uniformly stretched at a draw ratio of 1.9 and then false twisted.

The false-twisting conditions were as shown in Table 2 below. The properties of the false twisted yarns are also shown in the table. The yarn according to the invention (Run No. 8) was of desirable configuration in that it contained many more portions having genuine twists as compared with the yarn outside of the invention (Run No. 7).

Table 2

| Run No. | | 7 | 8 |
|---|---|---|---|
| 144 | 176 | | |
| Material Yarn | Denier | Uniformly drawn | Non-uniformly drawn |
| | Drawing | | |
| Conditions of False-twisting | Machine | TFT-6*1 | TFT-6*1 |
| | Temperature of heater (° C) | 210 | 210 |
| | Number of Twists (T/M) | 2,500 | 2,420 |
| | Twisting Tension (g/filament) | 12 | 25 |
| | Untwisting Tension ( " ) | 30 | 42 |
| | Overfeed percentage (%) | +2 | −13 |
| | Twisting Direction | S | S |
| | Uster Persent Value | 0.8 | 3.5 |
| | Shrinkage in Boiling Water (%) | 5.2 | 7.2 |
| Properties of False Twisted Yarn | C.R. Value (%) | 41.2 | 40.9 |
| | Tensil Strength (g/d) | 4.0 | 3.2 |
| | Elongation (%) | 24.0 | 34.0 |
| | Number of Not-untwist portions*2 | 5 | 300 |
| | Average Length of Not-untwisted Portions (mm) | 5 | 13 |
| | Twist Retention Coefficient | 30 | 85 |

*1 Single heater type false-twisting machine having a heater length of 1.2 m and provided with a spindle type twister, manufactured by Toray Engineering Co., Ltd., Japan
*2 Number of not-untwisted portions per 100 m

EXAMPLE 4

A thick and thin yarn of 155 denier/48 filaments, having birefringences of $39 \times 10^{-3}$ in the thick sections and of $123 \times 10^{-3}$ in the thin sections prepared from a highly oriented polyethylene terephthalate undrawn yarn, was false twisted under the conditions of overfeed percentage of −7%, twisting tension of 15 to 21 g, untwisting tension of 30 to 42 g, temperature of 210° C and number of twists of 2,420 T/M. The obtained yarn was doubled by imparting S twists of 200 T/M. Then, using the doubled yarn as both warp and weft, a 2/2 twill fabric of 62 ends per inch and 59 picks per inch was woven under a warp tension of 30 to 35 g and a weft tension of 20 to 25 g.

A tropical fabric of 95 ends per inch and 60 picks per inch was also woven using a conventional false twisted polyethylene terephthalate yarn of 75 denier/24 filaments as warp and the above-mentioned yarn as weft.

These fabrics were then scored at 75° C for 20 minutes in water containing an anionic surfactant and soda ash, and dyed using 3% o.w.f. (based on the weight of the fabric) of Dianix Navy Blue ERFS (C.I. Disperse Blue 142) at 100° C for 30 minutes. The fabrics were then subjected to reduction washing with caustic soda, hydrosulfite and a nonionic surfactant. After drying, fabrics of desirable sprinkly colored effects were obtained.

In the dyed twill fabric, the degree of deeply dyed portions was 44.7% and the lengths of deeply dyed portions were in a range of 1 to 5 cm, and the average length was 2.3 cm; while in the dyed tropical fabric, deeply dyed portions of the same lengths as above were observed only in weft. The fabrics possessed a unique and favorable feel and good fastness properties.

EXAMPLE 5

A polyethylene terephthalate undrawn yarn, a birefringence of which was $37 \times 10^{-3}$, was drawn using a hot pin of 35 mm $\phi$ heated to 80° C to obtain a thick and thin yarn of 160 denier/30 filaments having an Uster evenness value of 12% and birefringences of $37 \times 10^{-3}$ in the thick sections and of $105 \times 10^{-3}$ in the thin sections.

The obtained thick and thin yarn was false twisted under the following conditions. The temperature of the first heater was 210° C, the temperature of the second heater was 200° C, the relax rate was 15%, the ratio of twisting tension to untwisting tension was 2.4 and the number of twists was 2,400 T/M. The Uster percent value of the obtained yarn was 4.5 and the T index thereof was 13.

Using this yarn, an interlocking rib fabric was knitted on a circular knitting machine of 20 gage. The fabric was then relaxed at 90° C for 20 minutes and dried at 70° C for 30 minutes. Then, the fabric was dyed on beam dyeing equipment using 1.0% o.w.f. of Foron Rubine S-2GFL (C.I. Disperse Red 167), 3% o.w.f. of Foron Red S-FL (C.I. Disperse Red 72) and 1% o.w.f. of a nonionic dispersing agent, at 130° C for 60 minutes.

The fabric was dyed comparatively deep in the thick sections of the yarn-composing filaments and, thus, possessed stripes of a sprinkly colored effect in the weft direction. The degree of deeply dyed portions of this fabric was 38% and the lengths of deeply dyed portions were in a range of 0.5 to 3.0 cm, 1.5 cm being the average. The fabric possessed a unique and favorable feel and good fastness properties.

EXAMPLE 6

A polyethylene terephthalate undrawn yarn, having a birefringence of $40 \times 10^{-3}$, was drawn at a draw ratio of 1.38 using a hot pin heated to 80° C to obtain a thick and thin yarn of 150 denier/48 filaments having a birefringence of $41 \times 10^{-3}$ in the thick sections and of $110 \times 10^{-3}$ in the thin sections.

The thick and thin yarn was then false twisted under the following conditions. The overfeed percentage was −6%, the ratio of twisting tension to untwisting tension was 0.51, the temperature of the heater was of 210° C and the number of twists was 2,500 T/M. A false twisted yarn having crimps of various wave lengths was obtained. In the obtained yarn, the percentage of crimps having wave lengths not less than 1.5 mm observed under a tension of 2 mg/d was 24% and the number of crimps was 22 per inch on the average.

Then, the yarn was doubled by imparting twists of 200 T/M and a 2/2 twill fabric of 60 ends per inch and 55 picks per inch was woven using the doubled yarn under a warp tension of 35 g and a weft tension of 25 g. In the fabric thus woven, many skip-dents in the form of slits were observed.

The fabric was scored and relaxed at 75° C for 20 minutes, heat set with hot air at 180° C for 30 seconds without extending the width, dyed at 100° C for 60 minutes and, then, heat set at 160° C for 30 seconds with extension of the width to such an extent that the creases resulting upon dyeing were removed.

The fabric thus processed had a very soft, smooth feel touch and, thus, had a feel clearly different from those of fabrics produced from conventional false twisted yarns. The birefringence of the fabric was 0.56 in the warp direction and 0.64 in the weft direction, and the ratio of the lower value of the friction coefficient to the higher value of the friction coefficient was 0.87. The specific volume was 2.55 $cm^3/g$ and the broken filament counts of the warp and weft yarns were less than 10 per 2,000 m.

EXAMPLE 7

A false twisted yarn, the same as obtained in Example 6, was woven into a satin fabric and a plain fabric under the same conditions as in Example 6. The fabrics were then processed in the same manner as in Example 6. The obtained fabrics had a softer and smoother feel than those of fabrics produced from conventional false twisted yarns. The friction coefficients of the satin fabric and the plain fabric were 0.53 and 0.60, respectively, in the warp direction and 0.72 and 0.62, respectively, in the weft direction, and the ratios of the higher value of the friction coefficient to the lower value friction coefficient were 1.36 and 1.03, respectively. The specific volume was 3.2 $cm^3/g$ in the satin fabric and was 2.3 $cm^3/g$ in the plain fabric. In both fabrics, the broken filament count of the fabric-composing yarn was less than 10 per 2,000 m.

For comparison purposes, a uniformly drawn yarn of 150 denier/48 filaments, having a birefringence of $180 \times 10^{-3}$, was produced by drawing a polyethylene terephthalate undrawn yarn having a birefringence of $5 \times 10^{-3}$ at a draw ratio of 3.5 using a hot pin heated to 100° C. The drawn yarn was then false twisted under the following conditions. The overfeed percentage was +2%, the ratio of twisting tension to untwisting tension was 0.57, the number of twists was 2,500 T/M and the temperature of the heater was 210° C. In this yarn, the percentage of crimps having wave lengths of not less than 1.5 mm, observed under a tension of 2 mg/d, was only 3% and the number of crimps was 19 per inch on the average.

Then, the yarn was doubled in the same manner as in Example 6 and the doubled yarn was woven into a 2/2 twill fabric of 60 ends per inch and 55 picks per inch under a warp tension of 35 g and a weft tension of 40 g. In the fabric thus obtained, no skip-dents as in the fabric of Example 6 were observed.

The fabric was scored and relaxed at 100° C for 20 minutes and then processes in the same manner as in Example 6. The fabric thus processes had a hard and harsh feel. The friction coefficient of this fabric was 1.4 in the warp direction and 0.5 in the weft direction, and the ratio of the higher value of the friction coefficient to the lower value of friction coefficient was 2.8. The specific volume was 2.41 $cm^3/g$.

What is claimed is:

1. A textured polyester yarn having improved variation in dyeability along its length, comprising a plurality of individual filaments each having thick and thin sections randomly distributed along the filament axis and having an Uster evenness value of 1.0 to 10.0%, a T index of 3 to 30, a variation in reflected light intensity of ±0.15 to 0.80 and a broken filament count of not more than 100 per 2,000 m of the yarn length.

2. A textured polyester yarn according to claim 1, wherein not-untwisted portions containing genuine twists of a fixed direction are retained at random along its length.

3. A textured polyester yarn according to claim 2, wherein said not untwisted portions have a length of 1 to 150 mm and 20 to 1,500 exist per 100 m of the yarn length, and the twist retention coefficient of said portions is not less than 70.

4. A textured polyester yarn according to claim 1, wherein the ratio is cross-sectional area of the thickest sections to the thinnest sections of said individual filaments is 1.4 to 2.7, the Uster evenness value is 1.5 to 8.0%, the T index is 5 to 25, the variation in reflected light intensity is ±0.20 to ±0.60 and the broken filament count is not more than 80 per 2,000 m of the yarn length.

5. A textured polyester yarn according to claim 1, wherein said yarn comprises polyethylene terephthalate.

6. A knitted fabric of a color tone of a sprinkly colored effect comprising a textured polyester yarn according to claim 1, in which the degree of deeply dyed portions is 30 to 50% and the lengths of the continuous deeply dyed portions are in a range of 0.25 to 8 cm.

7. A woven fabric of a color tone of a sprinkly dyed effect comprising a textured polyester yarn according to claim 1, in which the degree of deeply dyed portions is 30 to 50% and the lengths of the continuous deeply dyed portions are in a range of 0.25 to 8 cm.

8. A woven fabric comprising a textured polyester yarn according to claim 1, in which the friction coefficient is not more than 1.2 in both warp and weft directions, the ratio of the higher friction coefficient to the lower friction coefficient is not more than 1.5 in both warp and weft directions and the specific volume is not less than 2.0 $cm^3/g$.

9. A process for the production of a textured polyester yarn, comprising false twisting a polyester yarn composed of a plurality of individual filaments each having thick and thin sections randamly distributed along the filament axis, in which the thick sections have a birefringence of 15 to $80\times10^{-3}$ and the thin sections have a birefringence of 90 to $200\times10^{-3}$, at a temperature of 180 to 230° C and under a twisting tension of 0.05 to 0.8 g/d, with a variation with respect to the average twisting tension of ±5 to ±20% and an untwisting tension of 0.1 to 0.8 g/d.

10. A process according to claim 9, wherein the ratio in cross-sectional area of said thick sections to said thin sections is 1.4 to 2.7, the birefringence is 25 to $80\times10^{-3}$ in said thick sections and is 90 to $200\times10^{-3}$ in said thin sections, the twisting tension is 0.08 to 0.5 g/d and the untwisting tension is 0.15 to 0.6 g/d.

11. A process according to claim 9, wherein the Uster evenness value of the polyester yarn to be false twisted is 4.0 to 15.0% and the T index of said polyester yarn is 20 to 90.

12. A process according to claim 9, wherein the polyester yarn to be false twisted is a polyethylene terephthalate yarn.

13. The textured polyester yarn according to claim 1, wherein said yarn is crimped.

14. A woven fabric comprising a textured polyester yarn according to claim 1.

* * * * *